United States Patent [19]

Thomas

[11] 3,957,007

[45] May 18, 1976

[54] AIR POWERED WATER PROPULSION METHOD AND APPARATUS

[75] Inventor: John R. Thomas, Wichita, Kans.

[73] Assignee: The Thomas Company, Wichita, Kans.

[22] Filed: Nov. 15, 1974

[21] Appl. No.: 524,035

[52] U.S. Cl. ..... 114/16 A; 61/70; 115/6.1; 128/142.2; 354/82

[51] Int. Cl.[2] ..... A63B 31/00

[58] Field of Search ..... 115/6.1; 114/16 A; 61/70; 128/142.2; 354/81, 82, 64

[56] References Cited

UNITED STATES PATENTS

| | | | |
|---|---|---|---|
| 1,271,012 | 7/1918 | Blanc | 128/145 R |
| 2,406,888 | 9/1946 | Meidenbauer | 128/142.2 |
| 3,066,638 | 12/1962 | Andersen | 115/6.1 |
| 3,084,654 | 4/1963 | Rosenberg et al. | 114/16 A |
| 3,128,739 | 4/1964 | Schultz | 115/6.1 |
| 3,411,474 | 11/1968 | Curtis | 115/6.1 |
| 3,415,211 | 12/1968 | Hamdton | 61/70 X |
| 3,433,222 | 3/1969 | Pinto | 128/142.2 |
| 3,584,594 | 6/1971 | Poutout | 115/6.1 |
| 3,789,788 | 2/1974 | Peroni | 115/6.1 |

*Primary Examiner*—Trygve M. Blix
*Assistant Examiner*—Gregory W. O'Connor
*Attorney, Agent, or Firm*—Duane C. Bowen

[57] ABSTRACT

A vessel operable by a diver for use in towing himself has an air motor powered by the diver's air tank. All or part of the air used by the diver passes through the motor. Air used by the motor in excess of air needed for breathing is exhausted into the vessel wake to reduce drag. A manifold, connected to the diver's air breathing means and to the tank, provides air connections to the vessel during towing operations and is quickly detachable and provides connection from the tank to the air breathing means when the diver operates away from the vessel.

23 Claims, 11 Drawing Figures

FIG. 10
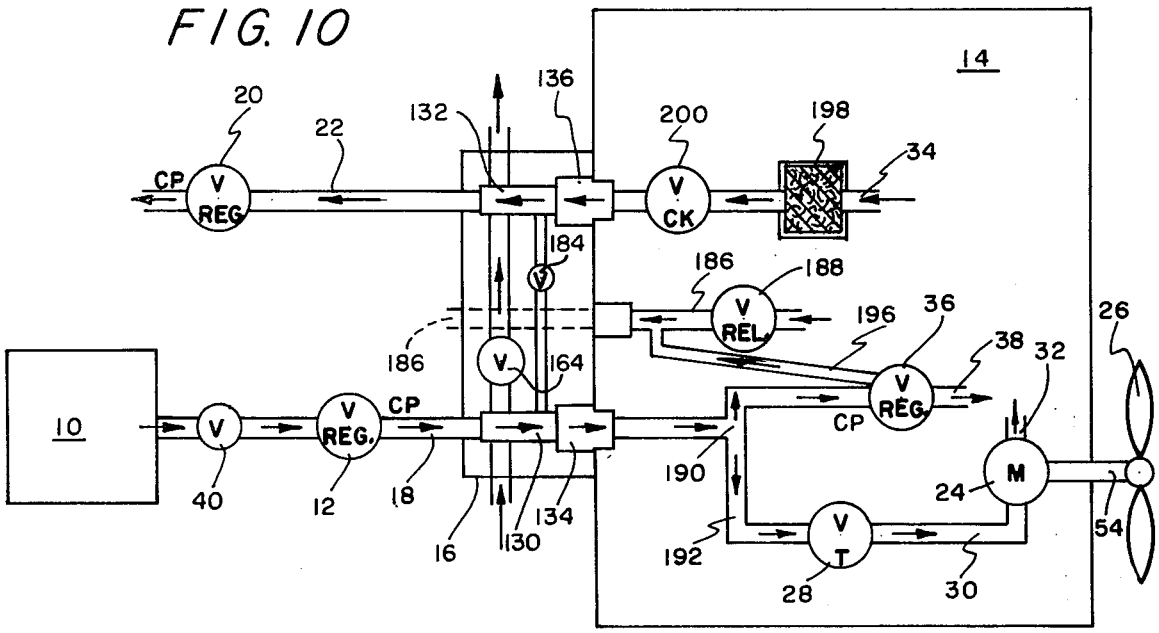
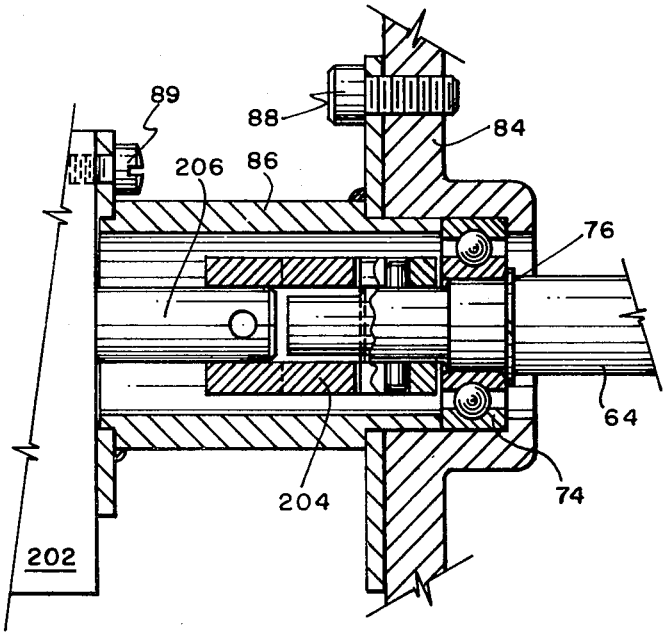
FIG. 11

AIR POWERED WATER PROPULSION METHOD AND APPARATUS

BRIEF SUMMARY OF THE INVENTION AND OBJECTIVES

My invention concerns towing vessels for divers and, more particularly, to a towing vessel with an air motor in which all or part of the air used by the diver passes through the motor. This form os propulsion could be termed "free" in the sense that the diver has to carry substantially the same amount of air for breathing purposes, in any case, and my form of propulsion utilizes mostly energy otherwise wasted, The invention relates to the art of Self Contained Underwater Breathing Apparatus commonly known as SCUBA. Such apparatus is used in commercial and sports diving. Compressed air, usually back-pack carried by a diver, supplies air for breathing underwater. The air is expanded from a highly compressed state to a substantially lower pressure for breathing. In my invention, part of all of this air is used for powering a towing vehicle, which is a new concept in the SCUBA art as far as I know.

PROBLEMS AND OBJECTIVES

Stored energy in the form of direct current electrical storage batteries have been quite successfully employed in providing underwater propelling power for divers. However, some problems are inherent in electric storage battery-powered underwater propulsion mechanisms:

a. Once discharged, storage batteries usually require removal from the propulsion mechanism to recharge, the mechanism being inoperative several hours during recharging unless standby storage batteries are employed.

b. Storage battery recharging facilities are often nonexistent at or near the areas of battery discharge occurrences.

c. The inherently heavy weight associated with lead-acid storage batteries, along with their bulky size, necessitates their employment, for buoyancy reasons, within a relatively large vessel which is difficult for divers to carry and to manipulate when submerged in the water.

d. Lead-acid storage batteries emit a hydrogen gas when they are discharged within a closed vessel, said gas being highly flammable. Such gas emission requires the vessel's battery compartment to be effectively sealed and safely isolated from its electric motor and electric switches, to prevent explosions endangering the life of a diver using the mechanism. Catalizers may be employed within battery compartments to convert the dangerous hydrogen gas and oxygen to harmless water, but corrosion reduces their effectiveness unless such is removed from the catalizers by servicing at appropriate intervals.

e. Most of the storage battery-powered propulsion mechanisms are ordinarily provided with an off/on power control switch. Such mechanisms must be operated at top speed, or must be "pulsed" to obtain propulsion at less than top speed. Additional electrical controls are sometimes optionally offered, usually at relatively high costs, to obtain variable propelling speeds.

f. Longer-lasting silver-zinc or nickel-cadmium storage batteries are sometimes optionally offered for some brands of propulsion mechanisms. Such "exotic" batteries have very high initial costs and require use of expensive, special recharging equipment.

g. It is well known that the servicing and handling of acid-filled storage batteries involves possible acid spillage. Acid damage to people's clothing or injury to their skin is a hazard when such batteries are the source of power for propulsion apparatus used by divers.

As far as I know, I am the first to propose use of air normally used for breathing to power a diver's towing vehicle. I conceived of the invention at a time I was involved as a consultant on a new type of engine. Coincidentally, a relative visited me at the time, who had recently earned a SCUBA instructor's license. He had encountered underwater propulsion units powered by batteries, and suggested to me a need for better propulsion means, although he did not suggest air power. Although the engine upon which I was working was proposed for gasoline power, its adaptability for air power may have contributed to my conception of powering a towing vehicle with an air motor.

Certain factors, however, were discouraging to my idea. One factor was the bulk and heavy weight of that type of engine, although a considerable time later, after "test bed" experimentation, the designer of the engine came up with a lower weight, more compact engine.

Subsequent investigations and tests involved off-the-shelf air motors, but initial tests with the type of new motor referred to above proved the theory that compressed air could be utilized simultaneously for propulsion and for breathing. Observe that the questions include not only such compatability but also whether enough energy is stored in a diver's compressed air tank to power a towing unit for a suitable period of time, whether an air motor and related system can be provided with the level of efficiency required for this application, whether use of air by a diver after motor use is feasible, etc. Another consideration is adaptability for use at various needed or desirable depths. Initially the test bed had walls that were unduly heavy, because of pressures involved, whereas later a system was developed in which pressures were controlled to levels wherein lighter walls were used. The initial test unit was considerably negative in buoyancy and an external buoyant suspension means was used.

The first test unit did not automatically provide the minimum air volume needed for diver breathing, so this was a problem that had to be solved. As mentioned above, this unit was heavy to withstand 120 psi air pressure supplied by a SCUBA first-stage regulator. The high pressure resulted not only in a requirement for strong, heavy walls, but also resulted in rather low water thrust due to internal air pressure built up from the motor exhausting into the vessel interior.

A second test bed included an air-for-breathing regulator to insure provision of breathing air for the diver regardless of how much or how little air was used for powering the air motor for propulsion. As will later be developed, the air regulator involved was inoperative until the need was defined for a "vented" regulator.

Most air motors require constant liquid oil lubrication, usually fed into air supply lines by appropriate applicators. Obviously, air for diver's breathing will not tolerate such lubrication techniques. Further, off-the-shelf motors often can use excessive air in cubic feet per minute, as they usually have been designed for applications with relatively unlimited supplies of air available. If clearances could not be sealed somewhat by the pressence of lubricating oils, then air consumption was particularly high. A designer could have given up on the grounds a motor could not be found which would run dry and have a suitable level of efficiency. However, efforts have been persisted with graphite filled Teflon pistons, anodized steel bores, spring-pressed seals (i.e., seals manufactured by Bal Seal Engineering Company of Tustin, California), precision honing, chrome plating, resurfacing and resizing by centerless grinding, etc., and it is believed the problem will be solved, int the usual process of design development, of providing a motor that can run dry and will have a suitable efficiency, as an adaptation of an off-the-shelf motor with an assured supply. The original motor mentioned above apparently could be adapted satisfactorily but an assured supply source has not been developed. The latest improvement for air motor cylinder bore surfaces is to strip off anodization and to apply molybdenum disulfide ($MoS_2$) dry lubricant. This was done by the Wichita, Kansas, firm of Metal Finishing Company, Inc., licensed by Drilube Company of Glendale, California, to perform such bonding of $MoS_2$ compounds produced by Drilube. Results have been quite satisfactory to date.

The foregoing discussion gives some indication of the nature of the conceptions involved in my invention, and contains implicit objectives. Explicity, some of the objectives of my invention include:

1. To employ, as the source of energy for propulsion, stored compressed air, the natural and always present breathing component of SCUBA systems, making available to divers substantially "free" underwater propulsion.
2. To employ air-for-breathing circuitry as part of an overall air-driven underwater propulsion apparatus, the circuitry including air manifolding means which is readily detachable from the propulsion apparatus, the manifolding then remaining temporarily as part of the air-for-breathing circuitry only, until the manifolding is reassembled to the propulsion apparatus.
3. To automatically provide and maintain an air source for diver breathing, regardless of an extent of use of such air as an energy source for the diver's underwater propulsion.
4. To automatically dispel all air that during propulsion may exceed the volume of air required for diver breathing, the dispelled air being discharged from the underwater propulsion apparatus so as to aid in reducing drag of the wake of water trailing the underwater propulsion apparatus.
5. To provide when desired for "buddy" breathing by means of readily applied auxiliary breathing circuitry to air-driven underwater propulsion apparatus.
6. To provide for "buddy" propulsion when desired, by means of readily applied auxiliary breathing circuitry adaptable to air-driven underwater propulsion apparatus, whereby stored compressed air carried by the "buddy associate" can also be used as a source of stored energy for diver's underwater propulsion apparatus.
7. To eliminate requirement of bulky, heavy electric storage batteries as a source of energy for underwater apparatus, whereby the apparatus becomes smaller, very much lighter and more easily maneuverable, through employment of stored compressed air as the source of energy for the apparatus.
8. To provide a somewhat buoyant towing vessel for a diver which will somewhat nose up whenever it is not otherwise controlled, so as to provide guidance to the surface especially when the diver is in water conditions of poor visibility.

9. To provide, in the type of vessel described, a limited bypass between means connected to the diver's compressed aair tank and means connected to the diver's breathing means, for supplementary momentary static responsiveness, for better response of a second stage regulator associated with such breathing means.

The apparatus used in my invention to achieve the above objectives includes, among other parts, the following, which will indicate the general system:

a. a buoyant vessel enclosing power transmitting means,
b. a manifold element for air input and air output and detachable from the vessel, the output being breathable,
c. carrying and guiding handles on the vessel, one of the guiding handles having movable means for controlling the flow of air through power transmitting means,
d. an air supply control means within the vessel and adapted to provide a minimum level of air pressure within the vessel,
e. pressure-relieving means within the vessel to provide a maximum level of air pressure within the vessel, expelling air from the vessel when air in excess to the volume used for breathing is fed to the power transmitting means, and
f. the excess air being dispelled rearwardly of the vessel during its passage through the water and within the vessel's wake, whereby the vacuum of the wake is decreased.

My invention will be best understood, together with additional advantages and objectives thereof, from the following description, read with reference to the drawings, in which:

FIG. 1 illustrates a specific embodiment of my invention. A vessel, forming a buoyant container for certain elements of the air-driven underwater propulsion apparatus is shown from one side. To the rear is shown a typical SCUBA compressed air tank, having an air supply hose leading to the apparatus and having a breathing regulator and its hose draped over the tank's air control mechanism.

FIG. 10 is a schematical view of the components of the propulsion apparatus and of its connection to the diver's compressed air tank and to the diver's second stage regulator.

FIG. 11 is an enlarged side view, partly in section, showing certain details including a flexible coupling connecting the propeller shaft to the speed reducer shaft.

Figures 1, 2, 3, 4:
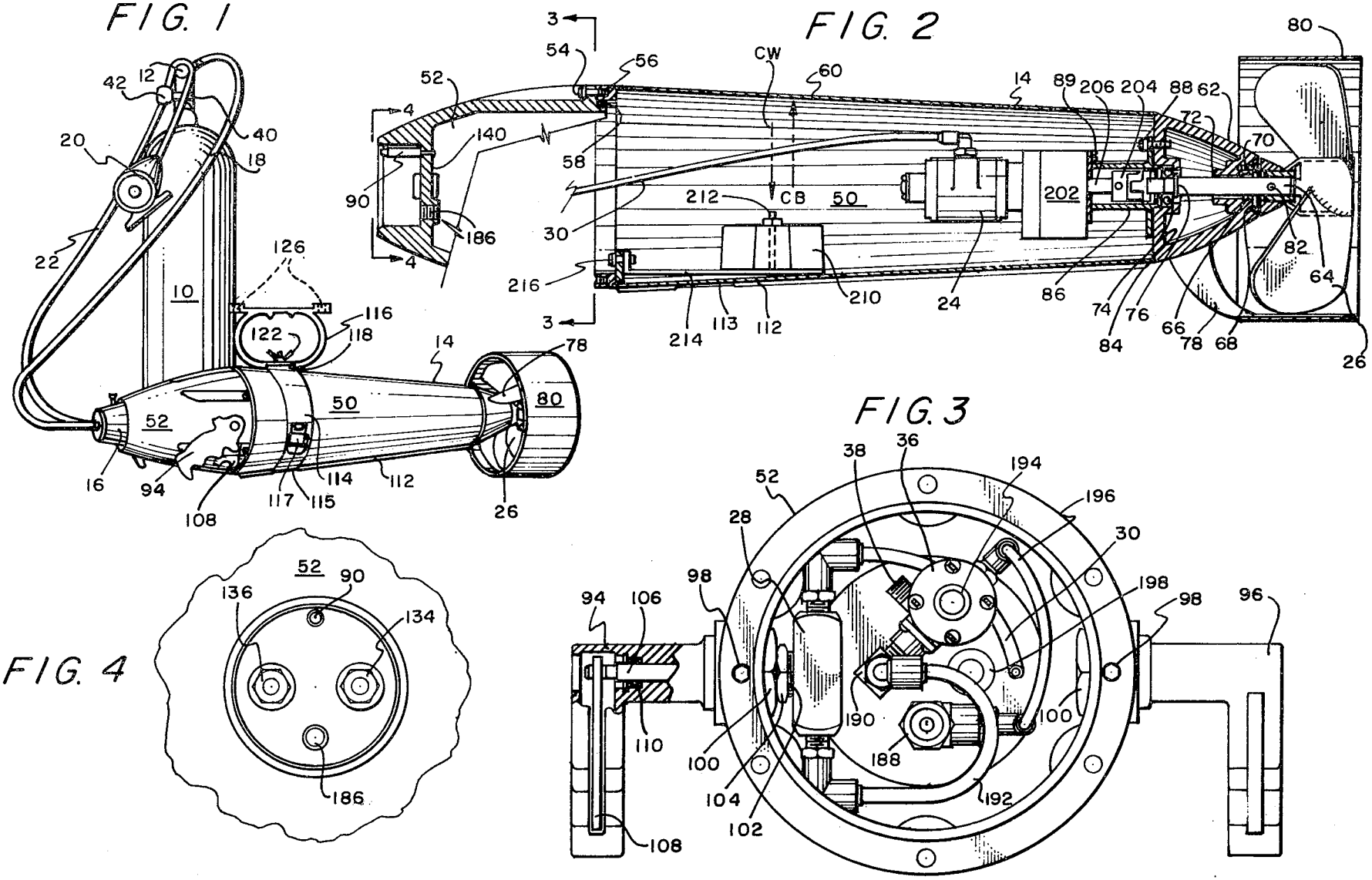
FIG. 2 is a partial side view, partly in section, showing portions of the vessel and the associated components.
FIG. 3 is an end view, taken generally as idicated by the line 3 — 3 of FIG. 2, of the rear section of the vessel and components contained therein. One guiding and control handle is shown partly in section to reveal internal details of the handle.
FIG. 4 is a partial end view, taken generally on the line 4 — 4 of FIG. 2, of the rear section of the vessel.
Figure 5:
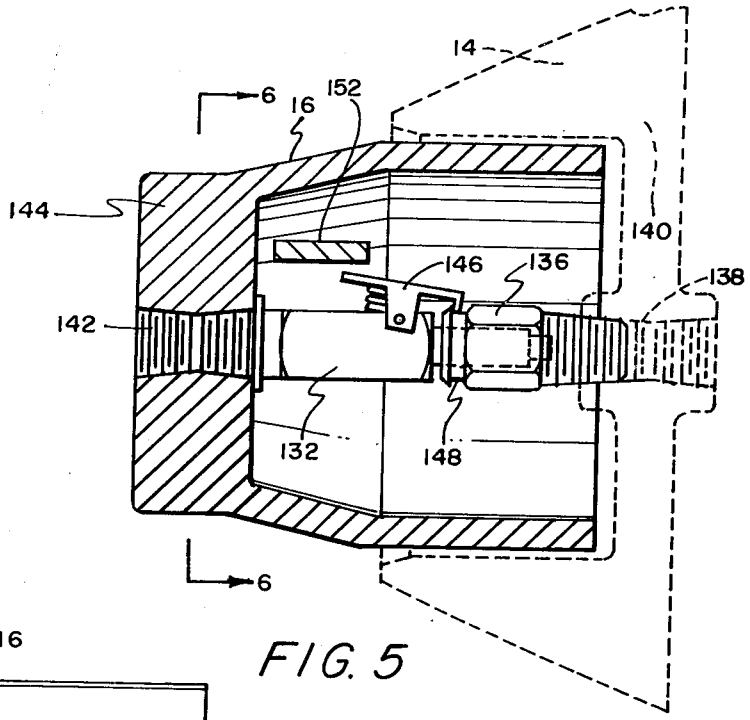
FIG. 5 is a view partly in section, taken as indicated by line 5 — 5 of FIG. 6, of a detachable air-input and air-for-breathing manifold. Dashed lines indicate the rear end of the vessel, in the position relative to the manifold the vessel will have when the manifold is attached to the vessel.
Figure 9:
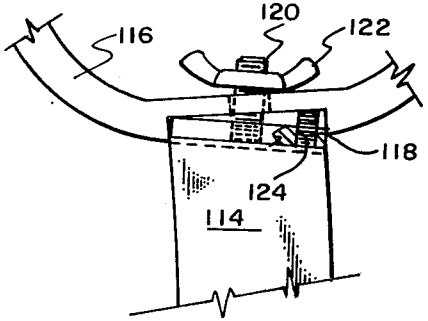
FIG. 9 is an enlarged, fragmentary side view of details of the connection of a carrying handle to a strap that encircles the vessel.
Figure 7:
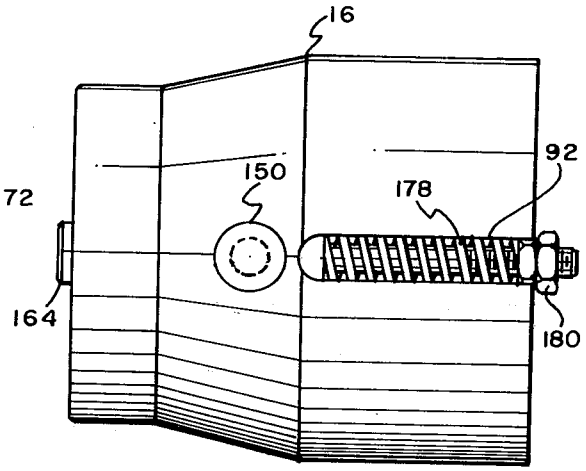
FIG. 7 is a top view of the manifold.

GENERAL DESCRIPTION primary units of my air powered water propulsion apparatus include a source of compressed air 10, a SCUBA first stage regulator 12, a towing vessel 14 having a detachable manifold 16 at one end, an air supply hose 18 from first stage regulator 12 to manifold 16, a SCUBA second stage regulator and mouthpiece 20, and a hose 22 between manifold 16 and regulator and mouthpiece 20. When manifold 16 is detached from vessel 14, air passes from hose 18 to hose 22 via passageways in manifold 16 to supply air to the diver. When manifold 16 is attached to vessel 14, air passes from hose 18 into vessel 14 (partly to power its motor) and air passes from vessel 14 to hose 22 to provide air for diver breathing. A primary novel feature of my invention is to use at least part of the air which the diver breathes to power such motor in vessel 16, to provide propulsion for the diver, when manifold 16 is attached to vessel 14.

Other primary units of my propulsion apparatus include an air powered motor 24, a propeller 26 driven by motor 24, a manually controlled air flow valve 28 for motor 24, a hose 30 connecting valve 28 to motor 24, an exhaust port 32 from motor 24 into vessel 14, an outlet 34 from vessel 14 connecting to hose 22 for delivery of air to second stage regulator and mouthpiece 20 and a regulator 36 to supply air through outlet 38 to vessel 14 (under centain circumstances later to be described) which has as one function a source of air for breathing to pass through outlet 34 to the extent, essentially, that insufficient air for breathing has passed through motor 24. It will be understood that the above units, in addition to others, are involved in supplying air to the diver which has had energy extracted by motor 24 to provide propulsion, and yet the diver is not dependent for air to breath on the amount of air passing through motor 24.

The above description provides a general idea of how my apparatus works. I will now describe these and other units in more detail.

COMPRESSED AIR SOURCE

A compressed air storage tank 10 is depicted. This can be a normal, high pressure compressed air tank presently used by SCUBA divers. It can be strapped to the diver's back, as in common present practice in which the tank is used merely to provide air to the diver's SCUBA second stage regulator and mouthpiece. Sometimes divers use double or triple tanks, manifolded together for common air delivery, and, obviously, single, double or triple tank configurations can be used in my invention. One example of a "twin pack" configuration in U.S. Diver's No. 0654, a connected pair of tanks manufactured by U.S. Divers Company, 3323 West Warner Avenue, Santa Ana, California 92702.

Connected to the tank or tanks is a "first stage" regulator 12, which may be of the present type used for SCUBA diving. An example of a first stage regulator on the market is the Voit Model MR12, manufactured by the W. J. Voit Rubber Corporation, a subsidiary of the American Machine & Foundry Company, 261 Madison Avenue, New York City, New York 10016.

Regulator 12 is mounted upon a conventional SCUBA "J" or "K" valve 40, which is an "off" and "on" valve. Valve 40 has a control knob 42, but the "on", "off" control could instead have the form of the commonly used push-pull rod extending to the lower region of tank 10 for better accessability by the diver. Air supply hose 18 is connected to the pressure regulated port of first stage regulator 14 and to manifold 16.

SECOND STAGE REGULATOR AND BREATHING MOUTHPIECE

A conventional SCUBA second stage regulator and mouthpiece 20 is applicable to use in my invention. One example of such second stage regulator now in use is Mark VII, manufactured by Scubapro, 3105 East Harcourt, Compton, California 90221. A flexible hose 22 connects the second stage regulator to manifold 16.

VESSEL AND ACCESSORIES

I will next more specifically describe vessel 14 and its accessories, before giving a complete description of manifold 16 and before going into a more specific description of the air circuitry involved in vessel 14.

Vessel 14 has a forward housing 50 and a rear housing 52. These housings are secured together by a plurality of bolts 54 extending through openings in rear housing 52 and secured in threaded openings in an annular reinforcing member 56 at the rear of forward housing 50. A seal between rear housing 52 and annulus 56 is provided by an "O" ring 58. The main part of forward housing 50 is formed by a thin aluminum sheet metal body section 60 having the shape of a frustum of a cone. The thick ring-shaped aluminum reinforcing piece 56 is preferably seam welded to the rear end of body section 60. Annulus 56 provides one of the surfaces for the "O" ring seal and provides material for tapped blind holes for bolts 54.

A cast aluminum propeller shaft support and closure 62 is preferably seam welded to the forward end of body 60. A propeller shaft 64 extends through closure 62. A propeller shaft rotary seal 66 is installed at the forward, outer end of closure 62 and is retained by a seal plate 68 maintained in position by a plurality of cap screws 70. A self-lubricating porous bronze bearing 72 performs as the outer support bearing for propeller shaft 64. Shaft 64 is axially located and has as an inner support a sealed and lubricated ball bearing 74 abutting a snap ring 76.

Closure 62 is provided with a plurality of integral, forwardly extending arms 78. The outer, forward ends of arms 78 are preferably joined by welding to a propeller shroud 80 surrounding propeller 26. Propeller 26 is mounted on shaft 64 and driven rotationally by a shear pin 82. An inner transverse wall 84 of closure 62 is fashioned to receive a ball-bearing retaining and air motor-supporting member 86, fastened to transverse wall 84 by cap screws 88 and to the housing of a speed reducer 202 by cap screws 89.

Rear housing 52, of cast aluminum, has a rearwardly extending guide bar 90 which clocks manifold 16 by fitting in a slot 92 in manifold 16. Bar 90 is tapered at its rear outer end to facilitate entry into slot 92. The reason for bar 90 to rotationally align manifold 16 with rear housing 52 will be evident when the details of manifold 16 are described.

Rear housing 52 supports a pair of control handles 94, 96, each shown extending through an appropriately machined opening in the outer, circumferential wall of housing 52. Air-tight junctures are provided by "O" ring seals, not shown. Handles 94, 96 are provided with a "flat land" against which set screws 98 are firmly installed to prevent relative rotation between control handles 94, 96 and rear housing 52. Each handle 94, 96 is additionally secured to rear housing 52 by a hexagon nut 100.

A flow control valve 28 is disposed in rear housing 52. The body of valve 28 has a threaded mounting hub portion 102 engaging an internally threaded bore of the shank of control handle 94. The inner end of the shank of control handle 94 is abutted by a lock nut 104 assembled on the valve's threaded portion 102 which, when tightened, prevents relative rotation between valve 28 and control handle 94. One example of an applicable control valve 28 is No. B-42F2, manufactured by Whitey Company, 5679 Landregan Street, Oakland, California 94608.

Valve 28 is actuated from "off", variably to "on", by a shaft 106 located within the central bore of handle 94. Shaft 106 extends outwardly for positive driven connection with a pistol grip-type trigger 108. Shaft 106 has a seal 110. FIG. 1 shows trigger 108 positioned at its neutral, zero power position. Trigger 108 is caused to return to "off" position, whenever it is released, by spring means located within the interior of handle 94 but not shown. As controlled by trigger 108, valve 28 feeds selected quantities of air through hose 30 to the input port of motor 24.

A rectangularly shaped "keel" bar 112 is preferably tack-welded to the bottom of body 60. Bar 112 provides a "notched" location 113 and a circumferential anchorage for accessory mounts.

A detachable, handle supporting strap 114 extends about body 60. A carrying handle 116 is selectively, adjustable mounted on strap 114. Strap 114 is provided with a compression spring draw pull-type catch 117 commonly known, which, when unlatched, permits optional removal of strap 114 from vessel 14. One example of such catch is No. SC-B-83314-42, manufactured by Nielsen Hardware Corporation, 770 Wetherfield Avenue, Hartford, Connecticut 06101. Preferably made of stainless steel, strap 114 is formed with a bend 115 in its bottom region so as to be keyed against rotation relative to vessel 14 by keel bar 112, bar 112 being somewhat recessed at 113 to retain strap 114 against axial movement relative to vessel 14.

The top-center portion of strap 114 includes a square mounting pad 118 which dimensionally approximates the strap's width. Pad 118 has a centrally located stud or bolt 120 which is threaded to receive a handle-retaining wing nut 122. Near each forward corner of pad 118 is located a threaded hole within which is installed a screw 124 to afford a "tilt" adjustment of handle 116.

Handle 116 serves dual purposes. The bottom portion of handle 112 is recessed to fit in overlapping manner the opposing sides of pad 118. By appropriate manipulation of wing nut 122, handle 116 can be positioned in axial alignment relative to vessel 14, as shown, whereupon it can serve, at least partly, as a vessel-carrying handle. Handle 116 can also be placed over pad 118 in a cross-wise position relative to vessel 10 in which it is particularly adapted for underwater camera support. The top portion of handle 116 is provided with holes 126 to receive bolts for fastening a camera, or a camera equipped with an adapter plate, to handle 116. The tilt screws 124 in pad 118 are adjustable to cause a camera's "field" to shift. In this way the camera can be adjusted to avoid having the propeller shroud 80 appear in the camera's field of view.

Keel bar 112 is not required as a structural member of vessel 14. It functions as a "key" for attaching auxiliary members to vessel 10 in the same manner as described in mounting strap 114, or otherwise, such as in the attachment of flash and flood lights, spear guns, extra compressed air tanks, ballast, etc., to vessel 14.

MANIFOLD

Manifold 16 probably will be machined out of aluminum bar stock, because of difficulties in coring of passageways for casting. As previously indicated, clocking of manifold 16 in attachment is accomplished by means of the rear housing guide bar 90 and the mating slot 92 in the manifold. Manifold 16 is adapted to make air connections to vessel 14 when attached thereto, and is adapted to pass air from compressed air source 10 to second stage regulator and mouthpiece 20 when the manifold is detached from vessel 10.

Manifold 16 includes two "quick-detach" type connections, each of which consisting of what is generally termed by "body" and an "insert". Compressed air tank 10 is connected to an insert 130 and the second stage regulator and mouthpiece is connected to an insert 132. Insert 130 connects with a body 134 and insert 132 connects with a body 136.

Bodies 134, 136, which are spaced apart side-by-side, are threadedly secured in threaded passageways 138 formed through the rear end wall 140 of rear housing 52. Inserts 130, 132 are threadely secured in threaded passageways 142 formed through the rear end wall 144 of manifold 16. Examples of these bodies and inserts on the market are, respectively, Imperial Nos. 298PB and 294PMB, manufactured by Imperial-Eastman Corporation, 6300 West Howard Street, Chicago, Illinois 60648.

Inserts 130, 132 (according to common manufacture) have spring-pressed pivoted latches 146 latching within annular grooves 148 in bodies 134, 136 respectively, to secure the inserts to the bodies. The bodies 134, 136 are released when latches 146 are pivoted out of grooves 148. The inserts are simultaneously releasable from the associated bodies by manipulation of a release bar 150 having a bridge 152 positioned to bear on the rear end of latches 146. This horizontally disposed bridge 152 has sufficient length to contact both latches 146. Release bar 150, centrally located between inserts 130, 132, extends upwardly through an opening 154 in manifold 16 and its upper end, outside manifold 16, is in position to be depressed by the diver to accomplish pivoting of latches 146 for release of bodies 134, 136 from inserts 130, 132. Both inserts and bodies are valved to prevent fluid flow therethrough when they are disengaged and separated from each other. This is not directional check valving, at least at nominally low pressures. Both the bodies and the inserts block flow of air or water therethrough when they become disconnected. During connection, a blowout of air occurs as each pair of inserts and bodies mate, so as to prevent water entry if they are underwater at the time. It will be understood from the foregoing that when insert 130 is coupled to body 134, air is supplied to vessel 14, and when insert 132 is coupled to body 136, air can be supplied from vessel 14 to the diver. I have not detailed the connection of hose 18 from tank 10 to the outer end of the passageway 142 in which insert 130 is secured or the connection of hose 22 to the outer end of its passageway 142 in which insert 132 is secured, but these are merely common connections of threaded fittings on the ends of the hose. Guide bar 90, acting in manifold slot 92, of course properly aligns manifold 16 relative to rear housing 52 so that inserts 130, 132 are properly registered with bodies 134, 136 during attachment of the manifold to the rear housing.

Figure 6:
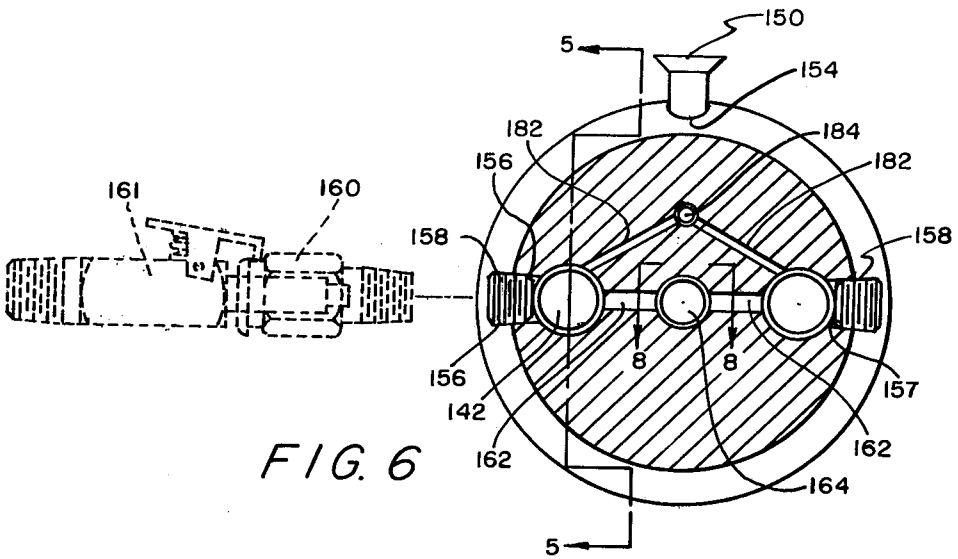
FIG. 6 is a view of the manifold partly in section, taken at line 6 — 6 of FIG. 5. In dashed lines to the left, in removed position, is depicted a body and an insert, to indicate how an air connection is made between the manifold and the apparatus of a buddy diver.

Manifold 16 also has lateral threaded bores 156, 157 joining passageways 142, which are normally closed with plugs 158. As indicated in dashed lines on the left side in FIG. 6, a body 160 (with associated insert 161) can replace one or more plugs 158. These are like bodies 134, 136 and inserts 130, 132. As will be reviewed later, this means a "buddy diver" can apply air from his tank to vessel 14 through bore 157 or can withdraw air from vessel 14 for breathing through bore 156, or both, by attaching hose from this tank and/or to this mouthpiece to the appropriate bore 157 or 156.

As before indicated, manifold 16 should connect air supply hose 18 to hose 22 to the diver's mouthpiece when the manifold is detached from vessel 14. Air passageway 162 is provided for this purpose and will be observed to accomplish the function of direct connection of hoses 18, 22, except when air passage is blocked by a centrally located, axially shiftable air control valve 164. As will be reviewed below, valve 164 has a first position permitting air flow through passageway 162 (when the manifold is detached from the vessel). Valve 164 also has a second position substantially blocking air flow through passageway 162 (when the manifold is attached to the vessel).

Figure 8:
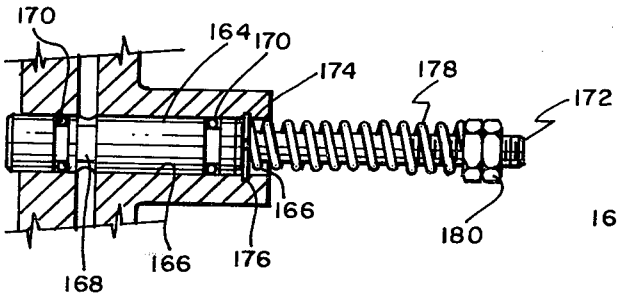
FIG. 8 is a fragmentary view, partly in section, taken as indicated by line 8 — 8 in FIG. 5, showing an air control valve in the manifold.

Valve 164 is positioned in an exial bore 166 through rear wall 144 of manifold 16. Bore 166 intersects passageway 162. Valve 164 has an annular recess 168 that is of a size to permit substantially unrestricted air flow through passageway 162, which means that in FIG. 8, valve 164 is disposed in said first position (when manifold 16 is detached from vessel 14). It will be observed that as valve 164 moves to the left from the position viewed (outwardly, rearwardly of manifold 16). recess 168 moves out of alignment with passageway 162 (when manifold 16 is attached to vessel 14), so that the valve substantially blocks flow of air through passageway 162. As there are no O-ring seals effective to block such flow, amount of leakage through passageway 162 past valve 164 is determined by the clearances between the cylindrical body of valve 164 and the cylindrical bore 166. There are O-ring seals 170 but they are to keep water out of passageway 162 or air from escaping out through bore 166.

Valve 164 has a stem 172. A snap ring 174, snapped into an annular groove 176, limits inward, forward movement of valve 164. A compression spring 178 on stem 172 between snap ring 174 and jam nuts 180 on the end of stem 172 urges valve 164 to said first position normally aligning annular valve groove 168 with passageway 162, which means that unless valve 164 is forced into a different position, air is available to the diver through passageway 162. The rear, outer end of valve 164 is exposed from the rear of manifold 16, so the diver can visually or tactually determine if the valve is in the first position to supply air to him upon detachment, and if it isn't he can press the end of the valve to bring the valve to the first position.

Valve 164 is forced to the second position (to the left as viewed) during attachment of the manifold to the vessel by abutment of the end of stem 172 with rear wall 140 of rear housing 52, and it will be understood that the length of stem 172 is designed to achieve that action. Therefore, in the attached position of manifold 16, air connections to and from vessel 14 are established through inserts 130, 132 and bodies 134, 136, and air flow through passageway 162 is substantially blocked.

O-rings 170 are preferably silicone-compounded. One example of such O-ring seals is No. ARP568-010-S59, manufactured by Plastic and Rubber Products Company, 2150 Parco Avenue, Ontario, California 91764.

Manifold 16 also has a by-pass air passageway 182 communicating between passageways 142 in which inserts 130, 132 are positioned. A self-locking adjustment screw 184 (positioned in a threaded blind hole and which may be covered by an access plug) midway in passageway 182 can be adjusted to control the amount of flow through by-pass 182. The purpose of the by-pass air, communicating between hose 18 and hose 22 even when manifold 16 is attached to vessel 14, is to provide a slight flow of air at 120 psi (a preferred setting of first stage regulator 12) to be applied to hose 22. This is an addition to the slight flow of air (in the attached position of manifold 16) which passes through air passageway 162 past air control valve 164. Screw 184 will be adjusted to provide sufficient total valve leakage and by-pass air to obtain good responsiveness of the diver's second stage regulator and mouthpiece 20.

The volume of air for the diver from vessel 10 is always adequate (the details of the air control and flow components in vessel 10 will later be discussed) for diver breathing. The static pressure (preferably 17 – 44 psi) as provided and controlled by regulator 36 and relief valve 188 (hereafter to be described) will be well above the (preferably about 1½ psi) air-for-breathing output of second stage regulator 20. However, as far as is known, all second stage regulators of various brands and models normally operate with an input pressure of about 120 psi. Accordingly, the response of most second stage regulators to the "suction" of a diver's breathing action is based on the usual 120 psi input from the associated hose. Such suction on the part of the diver initiates the air intake portion of the preathing cycle by causing the second stage regulator to change from "closed" to "open" condition. In other words, second stage regulators don't "draw" as easily with 17 psi inputs as they do with 120 psi inputs (using the term "draw" like "drawing" on a soft drink straw).

However in my system the "blow by" (minor leakage) of air through passageway 162 past valve 164 plus the flow of air through by-pass passageway 182 past adjustment screw 184 (although entirely insufficient for breathing volume required by the diver), can pass pressure at a level obtaining better responsiveness of second stage regulator 20. This can be termed "pressure transfer" rather than "volume transfer". The diver's breathing cycle not only has an intake portion (inhaling), it also has an expelling portion (exhaling). During the exhaling portion, second stage regulator 20 is closed, for it requires "suction" by the diver to open it. During the diver's exhalation duration, enough extra air pressure can be achieved in hose 22 via passageways 162 and 182, to achieve an input pressure to regulator 20 much higher than the 17 – 44 psi pressure that otherwise would be present.

AIR COMPONENTS WITHIN VESSEL 14

I have already mentioned the supply of air to motor 24, manually controlled air flow valve 28, hose 30 therebetween, exhaust port 32 from the motor to the interior of the vessel, outlet 34 connecting with hose 22, and regulator 36 supplying air to the vessel through outlet 38 to the vessel.

Any air volume excessive to a diver's breathing requirement and fed to motor 24, is released externally of vessel 14 by a discharge passage 186 through rear end wall 140, via appropriate clearance provided between the rear vessel wall 140 and manifold 16. This discharged air is readily visible to the diver as bubbles. Therefore, the diver can tell, by the presence or absence of these bubbles, whether the propulsion speed of the vehicle requires an air volume equal to or less than that required by the diver or an air volume in excess of that required for breathing by the diver. To the extent there are no bubbles of air "wasted," in effect the diver is getting a "free ride," i.e., no more energy (compressed air) is being used than would be used otherwise for his breathing. Note that air expelled in the wake of vessel 10 tends to reduce the "vacuum" effect behind the vessel. A pressure relief valve 188 connected to discharge passageway 186 controls the level of pressure at which air will be discharged through passageway 186. Relief valve 188 has an air pressure-relieving level that is somewhat higher than the pressure level automatically maintained within vessel 14 by regulator 36. One example of relief valve 188 is No. 301FM4B, manufactured by Pneu-Hydro Products, Inc., 52 Horsehill Road, Cedar Knolls, New Jersey 07927.

A "tee" fitting 190 is connected to the air inlet threaded passageway 138 associated with body 130. One branch of fitting 190 is connected to the manually controlled air valve 28 via a line 192. Regulator 36 is mounted on the other branch of fitting 190. As before indicated, regulator 36 has an air outlet 38 from which, at certain times, air for breathing flows into the interior of vessel 14 to automatically maintain a selected minimum of air volume and pressure therein. The pressure sensitive element 194 of regulator 36 is responsive to the pressure of air within vessel 14 to cause regulator 36 to function for the purpose intended. Examples of regulator 36 are Nos. 205D and 444, manufactured by Mosier Industries Inc., 2220 West Dorothy Lane, Dayton, Ohio 45439.

A vent line 196 leads from regulator 36 to the external environment by being connected to discharge passageway 186 outboard of pressure relief valve 188. Vent line 196 is an absolute "must" for regulator 36 to perform within the environment within which it is mounted, even though the volume flow of the vent line is almost imperceptible even if the discharge is viewed under water (in which case the volume flow might be described as approximating one small air bubble every 5 to 10 seconds). Another description of air volume through vent line 196 is that it could "drain off" vessel 14 of an internal pressure of 17 psi down to about 5 psi within 12 hours, if vessel 14 were not connected to tank 10 for resupply of air.

A regulator like 36 (similar in performance to those used for supplying a constant, low level volume and pressure of oxygen and acetylene to welding torches) won't work to pressurize an environment within which it is mounted unless the regulator is designed to be vented to a separate environment. This has been confirmed by my tests. The Mosier models above mentioned have vent-line connections. The reason for need of a vent line may be bleeding of air pressure to the wrong side of an actuating diaphragm. A Norgren Model R16-200-R30A regulator (C.A. Norgren Company, Littleton, Colorado 80120) is being tested which might be able to incorporate both the minimum pressure function of regulator 36 and the over-pressure function of relief valve 188.

A filter 198 is installed on discharge outlet 34 connecting from vessel 10 to line 22 (via body 136 and insert 132). A filter having a porosity of 6 microns is suitable. An example of filter 198 is No. 6655565, manufactured by Purolater Products, Inc., 1000 New Brunswick Avenue, Rahway, New Jersey 07065. A check valve 200, to prevent backflow, is also interposed in discharge outlet 34. An example of valve 200 is No. 43F, manufactured by Imperial-Eastman Corporation, 6300 West Howard Street, Chicago, Illinois 60648.

Air motor 24 may be of various types, i.e., one of the rotary output designs presently marketed. An example of an axial multiple piston type is Model No. 1511, manufactured by Standard Pneumatic Motor Company, 4980 Energy Way, Reno, Nevada 89502. The housing depicted in the drawings suggests a vane type of motor, and a pertinent example of the this type of motor is No. 1AM-NRV-60-GR11, manufactured by Gast Manufacturing Corporation, P. O. Box 97, Benton Harbor, Michigan 49002. The requirement of a motor that will not require a liquid lubricant and the desirability of closer tolerances than are common in air motors have been discussed previously. Motor modifications to meet requirements and optimize efficiency appear to be a matter of orderly development, i.e., the modification of a Model No. 1511 motor with $MoS_2$ dry lubricant as described may be a suitable solution to the problem of lubrication.

Power from motor 24 is delivered to a mating speed reducer 202, the combination being mounted on transverse wall 84. A flexible coupling 204 is interposed between the speed reducer's shaft 206 and propeller shaft 64. One example of such a flexible coupling is No. CHJP-I, manufactured by Browning Manufacturing Company, 1935 Browning Drive, Maysville, Kentucky 41056.

BUDDY OR LIFESAVING PROVISIONS

More than one diver can take advantage of the underwater propulsion provided by vessel 14 through employment of one or more of the options now described:

1. One plug 158 is removed from bore 156 in the air manifold 16 and replaced with a quick-detach body 160 equivalent to bodies 134, 136. A second diver, sometimes referred to in SCUBA diving as a "buddy," is equipped with a breathing regulator having its hose end-provided with a quick-detach insert 161 equivalent to inserts 130, 132. The buddy diver can, by mating such insert with such body (as indicated at the left in FIG. 6), use for breathing the filtered air present in the passage 138 associated with insert 132, simultaneously being propelled by vessel 14 through holding thereon or onto its operating diver.

2. The other plug 158 is removed from bore 157 in the air manifold 16 and replaced with a quick-detach body equivalent to bodies 134, 136. A buddy diver carrying a compressed air tank can have such tank's air hose provided in the form of two hoses branch-connected at the outlet of a first stage regulator. One of these will end-connect with a usual breathing regulator. The other hose will have, at its outer end, an insert equivalent to inserts 130, 132, which insert is mated to the body replacing plug 158 and in communication with the air supply passage 138 associated with insert 130. The buddy diver's compressed air tank storage is thus combined with the compressed air tank storage of the diver that is operating vessel 14, increasing the air available to power the motor 24 of the vessel 14 accordingly.

3. Rescue divers of a diving group, or such as for example policemen or firemen, may use a vessel 14 equipped with an auxiliary, stand-by breathing regulator and mouthpiece having its hose connected directly (or quick-detachable as in (1)), to the breathing air passage 138, via bore 156, associated with insert 132 through replacing the associated plug 158. The stand-by regulator and mouthpiece would provide an immediate breathing source of air for any diver needing help due to having exhausted the air supply he carries, or to experiencing a malfunction of equipment. Also, a swimmer overcome by fatigue, cramps or the like, or a drowning person could, in many instances be provided with the stand-by regulator and mouthpiece by the rescuer, enhancing the capability of making successful rescues.

OPERATION OF MY PROPULSION APPARATUS

The SCUBA diver regularly carries a back-pack mounted tank 10 which is appropriately filled with clean, breathable compressed air. To illustrate tank storage capacities, a single tank 10 usually holds slightly over 71 cubic feet of air when filled to a pressure of approximately 2000 pounds per square inch (psi). Some lately designed tanks contain over 80 cubic feet when filled to 3000 psi, whereas some European tanks hold considerably more than 80 cubic feet when filled to their designed capacity of 4500 psi.

The first stage regulator 12 on tank 10 reduces these relatively high air pressures to approximately 120 psi prior to flowing through the supply hose 18 to reach the manifold 16. It will be understood that the lengths of hoses 18 and 22 are such as to afford appropriate spaced relativity of tank 10 and regulator 20 to vessel 14, when manifold 16 is coupled with vessel 14 and the diver's hands are at their clasping positions on handles 94 and 96 of vessel 14.

To clarify the following description, manifold 16 will be considered as being in the "parking" mode of operation whenever it is not operatively engaged with vessel 14, whether out of the water as, for example, during a diver's preparation for diving, or under the water when vessel 14 is actually parked. Manifold 16 will be considered as being in the "propulsion" mode whenever it is operatively engaged with vessel 14.

1. Manifold 16 in parking mode:

Being disengaged from vessel 14, manifold 16 will, due to the axial thrust of spring 178, have its valve 164 shifted inwardly, to abut the snap ring 174 which performs as a valve stop. In this parking mode, the outer exposed end of valve 164 will be nearly flush with the left end of manifold 16, at which position the valve recess 168 alignment provides for unrestricted air flow through passageway 162 to be available for the diver's breathing use. It should be understood that the second stage regulator 20 is so constructed that no air will flow through hose 22, unless the diver "draws" or "sucks" slightly on the regulator's mouthpiece, whereupon air issues through the mouthpiece at approximately 1½ psi, if valve 40 on tank 10 is open.

2. Manifold 16 in propulsion mode a. Preparing for a dive with vessel 14

Manifold 16 can be operatively engaged with vessel 14, whether valve 40 of tank 10 is closed or open. However, for the purpose of this sequence in the description, valve 40 will be considered as being open when manifold 16 is connected. Immediately upon such engagement, air from tank 10, at the 120 psi output pressure provided by the tank's regulator 12, flows through hose 18 to manifold 16. Such air is substantially blocked from entering hose 22 due to the valve 164 having shifted to a position with recess 168 out of register with passageway 162.

Air enters the tee 190 to pass through regulator 36, exiting from its outlet 38 to build up the internal air pressure within vessel 14. When the air pressure within vessel 14 reaches a selected level, for example of 17 psi for which regulator 36 is designed to close, regulator 36 shuts off the air flowing out of outlet 38.

The air within vessel 14 can flow through the filter 198 and the check valve 200, through the quick-detach body 136 and its mating insert 132 to then flow through hose 22 and arrive at the breathing regulator 20. However, unless the diver is using air for breathing via regulator 20, flow of air through outlet 38 and into the interior of vessel 14 will diminish to zero as the 17 psi internal pressure in approached.

The volume of air flowing through outlet 38 will coincide with the volume of air being released by the regulator 20 as manipulated by the diver, whenever the propelling motor 24 is not being actuated. However, a slight flow of air, at the 120 psi pressure level as controlled by regulator 12, will by-pass valve 164 as well as the downstream regulator 36, via by-pass 182, as permitted by the adjustment screw 184 and will increase the static pressure of air within hose 22 and enhance the response-to-breathing of regulator 20. It should be noted that air through by-pass 182 will not result in flowing of 120 psi air into vessel 14 as that is prevented by check valve 200.

b. Diving with vessel 14

The preceding section (a) establishes that valve 40 of tank 10 is open. The diver may now enter the water and submerge with vessel 14, using regulator 20 for breathing. The diver's right hand, clasping one of the vessel's handles, can now depress the handle's trigger 108 as desired to variably open the valve 28 to admit air into hose 30 and actuate the motor 24, accomplishing propulsion.

As heretofore described, all of the air which passes through motor 24 exits directly into the interior of vessel 14 through its exhaust port 32. Whenever the volume of air use for propulsion exceeds the volume of air then being used for breathing, the internal air pressure within vessel 10 rises above the 17 psi provided by regulator 36, until it reaches a selected pressure-relieving level provided by relief valve 188 such as, for example, 24 psi. Thereupon, such propulsion air volume excess flows through relief valve 188 and the discharge passage 186, escaping into the water trailing vessel 14 via the appropriate clearance that I have provided between housing 52 and manifold 16.

As before observed, air being discharged into the wake of vessel 14 by relief valve 188 is readily visible to the diver as "bubbles," similar to the "breathed air" bubbles emerging in the vicinity of regulator 20, and the diver can govern speed accordingly if desired.

It will be understood that during relatively low propulsion speeds with vessel 14, or when it is motionless, for example, as during use of mounted cameras, the internal pressure within vessel 14 will lower from the 24 psi relief valve level, due to air being withdrawn for breathing, down to the 17 psi level as maintained by regulator 36.

c. Buoyancy of vessel 14

Vessel 14 can be equipped so as to have either a positive, neutral or negative buoyancy, as desired. Positive buoyancy is my preferred embodiment. The buoyancy description will be solely of vessel 14. If a camera or other equipment is being carried by the vessel, ballast weight needs to be changed in order to maintain the same buoyancy.

In a prototype of the type illustrated and without the addition of weights, vessel 14 had a positive, floating buoyancy force of approximately 7¼ pounds. One example of buoyancy treatment is to install a 5¾ pound weight 210 internally and centered slightly to the rear of handle 116, the handle being preferably located at or near the vessel's center of gravity. This treatment will provide a positive buoyancy of 1½ pounds in fresh water. If a 6¼ pound weight is used, a 1 pound positive buoyancy is obtained.

Ballast weight 210 is secured by a bolt 212 to a strap 214 that is secured by a bolt 216 to annulus 56. FIG. 2 indicates (from the configuration of a prototype) a center of buoyancy by a dashed line arrow marked "CB" and indicates the center of weight 210 by a dashed line arrow marked "CW." This achieves a nose-up attitude. In the prototype example, the distance between CB and CW was ¾ inch. The nosing-up force can be varied by changing this distance. Also in the prototype, the centerline of handle 116 was located between CB and CW, which means the weight of the vessel was substantially balanced about handle 116 for ease of carrying. Different ballasting to achieve the same buoyancy is needed for salt water rather than fresh water usuage. The weights cited above are for fresh water use. Weight 210 could be changed for salt water use. Another solution is to provide a suitable internal ballast for fresh water and to attach a streamlined ballast to keel bar 112 at an appropriate location whenever vessel 14 is to be used in salt water. In the configuration cited above, the addition of a salt water ballast weighing about ¾ of a pound would be appropriate. Buoyancy is, of course, a function of weight and displacement and these factors will vary from model to model, but the above figures on one particular model may be informative.

With buoyancy provided for as outlined in the preceding paragraphs, a descending dive will require a downward "tilting" of vessel 14 by the diver's hands. Accordingly, a relaxed or zero tilting control effort on the part of the diver will accomplish an ascending motion due to the tendency of vessel 14 to nose up. Such automatic ascent may be particularly appropriate or important in rising out of murky water having limited or no visibility. Without the addition of weight 210, the weight of vessel 14 is generally balanced about the center of buoyancy in the prototype described, so it is necessary to add weight 210 to the rear of the center of buoyancy to achieve the tendency of vessel 14 to nose up in that prototype.

3. Parking vessel 14 underwater

The diver may wish to park vessel 14 before entering an underwater cave, before examining the interior of a submerged ship, before traversing underwater passages having limited space for maneuvering, etc. Having positive buoyancy as heretofore described, vessel 14 will require some method of restraint when it is parked, such as by applying a chain or rope having appropriate fasteners, to anchor and restrain vessel 14 from rising to the surface or from being carried away by water currents.

Having provided suitable anchorage for vessel 14, the diver may depress release bar 150 on manifold 16, permitting separation of manifold 16 from vessel 14. Manifold 16 being an element of the diver's SCUBA system, the diver is now free to maneuver remotely from vessel 14. As previously described in the section (1) titled "Manifold 16 in parking mode", recess 168 of valve 164 aligns with passageway 162 within manifold 16, for direct flow of air from tank 10 to regulator 20.

Assuming that the diver now desires to resume the use of vessel 14, manifold 16 is operatively re-engaged with vessel 14. The preceding description in section (2) titled "Manifold 16 in propulsion mode" applies here, upon such re-engagement. It should be noted that the presence of pressured air within vessel 14 and within manifold 16 quick-detach elements permit the re-engagement of same without entry of water. Just as the quick-detach bodies and inserts of vessel 14 and manifold 16 are mated, such pressured air blows away any water that accumulated in such bodies and inserts while they were disconnected.

4. Buddy diving with vessel

Operation of buddy diving operations should be clear from preceding descriptions of buddy diver connections to manifold 16 and from the description of operations with a single diver. My provision of quick-detach bodies and inserts for joining the buddy diver's hose 22 and its regulator 20, or the buddy diver's supply hose 18, or both to manifold 16, as before described, offers a high degree of elective freedom associated with use of vessel 14. The buddy diver can elect to disengage from manifold 16 at any time, to proceed on his own, later re-engaging with manifold 16, regardless of the mode of operation then existing for the diver-operated vessel 14.

The foregoing has described use of vessel 14 by one diver and elective use by more than one diver. Other variations are feasible. For example, obviously one or more "belly"-attached compressed air tanks could be employed to commensurately increase underwater propulsion durations.

EFFECTS OF DEPTHS ON PRESSURE CONTROLS OF VESSEL 14

The spread between levels of control settings for regulator 36 and relief valve 188, of the type and model described herein, can be approximately 7 psi. It should be noted that such 7 psi differential applies when vessel 14 is atmospherically surrounded. Obviously, this defferential must not narrow appreciably at different depths, for if the control levels of regulator 36 and relief valve 188 met or crossed, tank 10 would discharge its air, inadvertantly, through passage 186.

I have conducted numerous tests on vessel 14 equipped with the described regulator 36 and relief valve 188. I have determined that the control level differential between these items remains quite constant at various depths under water, despite the fact that passage 186, which is the outlet for ventline 196 of regulator 36 and for discharged air escaping through relief valve 188, is subjected to the weight and pressure of the surrounding water. Results of my tests are indicated in the following table:

| Water Depth, Ft. | Psi level- Reg. 36 | Psi level- R.V. 188 | Psi Differ- ential |
|---|---|---|---|
| 0 | 18.2 | 26.0 | 7.8 |
| 4.6 | 19.5 | 28.0 | 8.5 |
| 13.8 | 24.2 | 32.0 | 7.8 |
| 27.7 | 30.0 | 38.0 | 8.0 |
| 41.6 | 35.0 | 44.0 | 9.0 |

The above data has been determined to be typical to a test depth of 150 ft.

PROPULSION PERFORMANCE DATA FOR VESSEL 14

A comparison between the thrust at selected levels produced by vessel 14 and the air consumed thereby, as related to the air required for breathing by a working diver, considered at various submerged depths and at water surface, is shown by the following chart:

| Under- water Depth- Feet | Vessel 14 Thrust- lbs. | Regu- lator 12 psi | Vessel 14 psi within | Vessel 14 Air CFM | CFM Required Working Diver |
|---|---|---|---|---|---|
| 0 | 6.75 | 125 | 26 | 4.95 | 3 |
| 0 | 10.0 | 120 | 29 | 5.94 | 3 |
| 33 | 9.75 | 118 | 40 | 5.94 | 6 |
| 66 | 10.0 | 120 | 44 | 7.76 | 9 |

At test depths of 150 ft., propulsion air requirement of vessel 14 does not vary exceedingly from the quantity required at the surface. However, a working diver requires 5 times as much air for breathing at a depth of 132 ft. than that required at the surface, at 132 ft. depth needing 15 CFM. In other words, the diver is more affected by depth on air consumption than is the propulsion requirements of the vessel. This means the propulsion system is well adapted to depths.

Having thus described my invention, I do not wish to be understood as limiting myself to the exact details shown and described, but instead wish to cover these modifications thereof which will occur to those skilled in the art and which are properly within the scope of my invention, and of the appended claims.

I claim:

1. Air powered underwater propulsion means for a diver who has a compressed air tank and has air breathing means, comprising:

a. a vessel operable by the diver for use in towing himself, b. said vessel having an air motor and a propeller connected thereto for powering said vessel, c. means connecting said tank to said vessel supplying air to said motor to power the same, d. means connecting said vessel to said breathing means supplying air for breathing including air that has previously passed through said motor, e. said means connecting said tank to said vessel and said vessel to said breathing means being detachable from said vessel and having means interconnecting the same supplying air from said tank to said breathing means when so detached from said vessel, f. said means connecting said tank to said vessel and said vessel to said breathing means having quick disconnecting means for connection to and release from said vessel, and g. said interconnecting means including a manifold and said quick disconnecting means including a pair of inserts secured to said manifold and a pair of bodies secured to said vessel, and including a single release member exposed to the outside of said manifold and a pair of latches acting on said bodies which automatically engage and are simultaneously released upon operation of said release member by said diver.

2. The subject matter of claim 1 in which said manifold and said vessel have male and female mating parts locking said manifold relative to said vessel for alignment of said inserts and said bodies.

3. Air powered underwater propulsion means for a diver who has a compressed air tank and has air breathing means, comprising:

a. a vessel operable by the diver for use in towing himself, b. said vessel having an air motor and a propeller connected thereto for powering said vessel, c. means connecting said tank to said vessel supplying air to said motor to power the same, d. means connecting said vessel to said breathing means supplying air for breathing including air that has previously passed through said motor, e. said means connecting said tank to said vessel and said vessel to said breathing means being detachable from said vessel and having means interconnecting the same supplying air from said tank to said beathing means when so detached from said vessel, and f. said interconnecting means including a manifold having a bore and a slidable valve member therein, said manifold having ports from said bore to said means connecting said tank to said vessel and said vessel to said breathing means, said valve member having spring means normally urging it to a first position and having abutment means abutting said vessel moving said valve member against said spring means to a second position when said interconnecting means is connected to said vessel, said valve member having means blocking flow of air between said ports in said second position and permitting flow of air between said ports in said first position thereof.

4. Air powered underwater propulsion means for a diver who has a compressed air tank and has air breathing means, comprising:

a. a vessel operable by the diver for use in towing himself, b. said vessel having an air motor and a propeller connected thereto for powering said vessel, c. means connecting said tank to said vessel supplying air to said motor to power the same,
d. means connecting said vessel to said breathing means supplying air for breathing including air that has previously passed through said motor, and
e. said breathing means including a second stage regulator, and there being a bypass line between said means connecting said tank and said vessel and said means connecting said vessel and said breathing means and an adjustable needle valve in said bypass line operative to supply an additional limited set maximum flow of air directly from said tank to said breathing means for the purpose of providing supplementary momentary static pressure to achieve better responsiveness of said second stage regulator, and a second bypass line and a control valve in said second bypass line operable to pass air directly from said means connecting said tank and said vessel to said means connecting said vessel and said breathing means to provide air to said diver when said means connecting said vessel and said breathing means is disconnected.

5. Air powered underwater propulsion means for a diver who has a compressed air tank and has air breathing means, comprising:
a. a vessel operable by the diver for use in towing himself,
b. said vessel having an air motor and a propeller connected thereto for powering said vessel,
c. means connecting said tank to said vessel supplying air to said motor to power the same,
d. means connecting said vessel to said breathing means supplying air for breathing including air that has previously passed through said motor, and
e. said means connecting said tank to said vessel including a first line directly connected to said motor, and a second line, an air regulator connected to said second line applying air to the interior of said vessel when the pressure within said vessel is below a level selected by said regulator, said motor exhausting to the interior of said vessel, said means connecting said vessel to said breathing means receiving air from the interior of said vessel, and pressure-relieving means within said vessel exhausting air therefrom when air pressure therein is in excess of a level set by said pressure-relieving means, the pressure level set for exhaust by said pressure-relieving means being higher than the minimum pressure level set by said air regulator, whereby air is exhausted by said pressure-relieving means when the volume of air passing through said motor is in excess of the volume withdrawn from said vessel by said means connecting said vessel to said breathing means.

6. The subject matter of claim 5 in which said means connecting said tank to said vessel has interposed therein adjacent to said tank a pressure regulator which is set at a level higher than said air regulator, and said breathing means having a second-stage regulator.

7. The subject matter of claim 5 in which said pressure-relieving means has its exhaust directed into the wake of said vessel to reduce the vacuum of the wake.

8. Air powered underwater propulsion means for a diver who has a compressed air tank and has air breathing means, comprising:
a. a vessel operable by the diver for use in towing himself,
b. said vessel having an air motor and a propeller connected thereto for powering said vessel,
c. means connecting said tank to said vessel applying air to said motor to power the same,
d. means connecting said vessel to said breathing means applying air for breathing including air that has previously passed through said motor, and
e. a keel bar extending longitudinally of the bottom of said vessel providing a notched circumferential anchorage for accessories.

9. The subject matter of claim 8 in which there is a detachable circumferential strap on said vessel keyed against rotation on said vessel by said keel bar, and said keel bar being recessed to prevent movement of said strap longitudinally of said vessel, a mounting pad on said strap at the top of said vessel, a carrying handle mounted on said pad and having its bottom recessed to fit said pad, a releasable bolt securing said handle to said pad whereby said handle can be adjusted in position between a first position aligned longitudinally of said vessel and a second position extending laterally of said vessel, said handle having means for camera mounting for support of the same, and there being screws threadedly engaged in said pad for tilt adjustment of such camera.

10. Underwater propulsion means for a diver, comprising:
a. a vessel operative to tow a diver underwater,
b. said vessel having a ratio of displacement to weight making it buoyant, and
c. the weight of said vessel being distributed relative to the center of buoyancy of said vessel so that said vessel tends to nose up whenever it is not controlled to other disposition by said diver, whereby when said vessel is being propelled and is not otherwise controlled it will follow a path to the surface.

11. The subject matter of claim 10 in which the weight of said vessel is normally substantially balanced about the center of buoyancy of said vessel and in which said vessel has added attached weight means disposed to the rear of said center of buoyancy to produce the distribution of weight of said vessel achieving the tendency of said vessel to nose up.

12. Underwater propulsion means for a diver, comprising:
a. a vessel operative to tow a diver underwater,
b. a detachable circumferential strap on said vessel,
c. a carrying handle mounted on said strap,
d. said handle having means for camera mounting for support of the same, and
e. a keel bar extending longitudinally of the bottom of said vessel, said bar having a partial recess in which said strap is secured to prevent displacement of said strap longitudinally of said vessel, and said strap having a form fitting said bar at said recess preventing movement of said strap circumferentially of said vessel.

13. Underwater propulsion means for a diver, comprising:
a. a vessel operative to tow a diver underwater,
b. a detachable circumferential strap on said vessel,
c. a carrying handle mounted on said strap
d. said handle having means for camera mounting for support of the same, and
e. a mounting pad on said strap at the top of said vessel, said handle being mounted on said pad and having its bottom recessed to fit said pad, a releasable bolt securing said handle to said pad whereby said handle can be adjusted in position between a first position aligned longitudinally of said vessel and a second position extending laterally of said vessel, and there being screws threadedly engaged in said pad for tilt adjustment of such camera supported on said handle.

14. The method of propelling a towing vessel for a diver having air breathing means and having a compressed air tank for providing air to said breathing means, comprising:

a. powering said vessel with compressed air,
b. supplying air from said tank to power said vessel during towing operations,
c. disconnecting said tank from said vessel during operations of said diver independent of said vessel while maintaining supply of air from said tank to said breathing means,
d. providing an air motor for said vessel and exhausting air from said motor to said vessel and supplying air from said vessel to said air breathing means so that said diver can use air that has been used to power said motor, and
e. exhausting air used to power said motor, in excess of air used by said diver, into the wake of said vessel and thereby reducing vacuum of said wake.

15. The method of propelling a towing vessel for a diver having air breathing means and having a compressed air tank for providing air to said breathing means, comprising:

a. powering said vessel with compressed air,
b. supplying air from said tank to power said vessel during towing operations,
c. disconnecting said tank from said vessel during operations of said diver independently of said vessel while maintaining supply of air from said tank to said breathing means,
d. providing an air motor for said vessel and exhausting air from said motor to said vessel and supplying air from said vessel to said air breathing means so that said diver can use air that has been used to power said motor, and
e. providing air to said motor from said tank at a first pressure and providing air from said tank to said vessel when air pressure in said vessel is below a second pressure, said second pressure of being lower than said first pressure, thereby providing supply of air to said vessel for said breathing means when insufficient air for breathing passes through said motor.

16. In the method of claim 15, exhausting air from said vessel into the wake of said vessel and thereby reducing vacuum of said wake when air pressure in said vessel is above a third pressure, said third pressure being higher than said second pressure and being lower than said first pressure.

17. Air powered underwater propulsion means for a diver who has an air tank and air breathing means, comprising:

a. a closed housing forming a vessel and having handle means to be grasped by a diver in being towed by said vessel,
b. an air motor within said housing and a propeller at the front end of said housing and shaft means extending through the forward end of said housing connecting said motor to said propeller,
c. first hose means connected to said air tank and second hose means connected to said air breathing means, and quick-disconnect means connecting said first and second hose means to said housing,
d. said first hose means connecting through its quick-disconnect means to said motor to supply air thereto in powering said motor, said air motor exhausting into said closed housing which acts to contain air that has passed through said motor, said second hose being connected to the interior of said housing through its quick-disconnect means for supply of air from said housing to said diver, and
e. said housing having a passageway from the interior to the exterior of said housing and a relief valve controlling exhaust of air through said passageway and operable to exhaust air to the outside of said vessel when the air pressure within said housing exceeds a preset level.

18. Air powered underwater propulsion means for a diver who has an air tank and air breathing means, comprising:

a. a closed housing forming a vessel operable by the diver in propelling himself, said housing having attached thereto propelling means operable to propel said vessel through the water,
b. first hose means connected to said air tank for supply of air to said vessel and second hose means connected to said air breathing means for supply of air from said vessel to said diver,
c. an air motor operative to operate said propelling means and said first hose connecting to said motor to supply air to power said motor, said air motor exhausting air into said closed housing which acts to contain air that has passed through said motor,
d. said second hose means connecting said housing to said air breathing means for supply of air from within said housing to said diver, and
e. said housing having a passageway from the interior to the exterior of said housing and a relief valve controlling exhaust of air through said passageway and operable to exhaust air to the outside of said vessel when the air pressure within said housing exceeds a preset level.

19. The subject matter of claim 18 in which said vessel has means operable to attach thereto an air tank from a buddy diver for additional supply of air to said motor.

20. The subject matter of claim 18 in which said vessel has means operable to attach thereto a line from breathing means of a buddy diver for supply of air to the buddy diver.

21. The subject matter of claim 18 in which said first and second hose are disconnectable relative to said vessel and interconnectable to supply air to said diver when he operates independent of said vessel.

22. The subject matter of claim 18 in which there is a detachable manifold on said housing, said first and second hose being secured to said manifold, said manifold having means automatically connecting said first hose to said second hose for supply of air from said tank to said air breathing means when said manifold is detached from said housing, said first hose is disconnected from said motor, and said second hose is disconnected from said housing.

23. The method of propelling a propulsion vessel for a diver having air breathing means and having an air tank for providing air to said breathing means, said vessel having an air motor and a closed vessel housing, comprising:

a. supplying air from said tank to said motor during propulsion operations, b. exhausting air passing through said motor into the interior of said housing, c. supplying air to said air breathing means from said interior of said housing during propulsion operations, d. exhausting air from said housing to the exterior of said vessel when pressure within said housing exceeds a preset level, and e. disconnecting said tank from said motor during diver operations independent of said vessel while supplying air from said tank directly to said breathing means.

* * * * *